US010987916B2

(12) United States Patent
Lee et al.

(10) Patent No.: US 10,987,916 B2
(45) Date of Patent: Apr. 27, 2021

(54) SCREEN PRINTING APPARATUS AND METHOD OF PRINTING INCLUDING CONTROLLING THE HEIGHT OF THE INK DROOP

(71) Applicants: HONDA MOTOR CO., LTD., Tokyo (JP); SUNARROW LTD, Tokyo (JP)

(72) Inventors: Seonghun Lee, Wako (JP); Yuichi Takahashi, Tokyo (JP); Tomoomi Kiyomiya, Tokyo (JP)

(73) Assignees: HONDA MOTOR CO., LTD., Tokyo (JP); SUNARROW LTD, Tokyo (JP)

( * ) Notice: Subject to any disclaimer, the term of this patent is extended or adjusted under 35 U.S.C. 154(b) by 139 days.

(21) Appl. No.: 16/357,477

(22) Filed: Mar. 19, 2019

(65) Prior Publication Data

US 2019/0283397 A1 Sep. 19, 2019

(30) Foreign Application Priority Data

Mar. 19, 2018 (JP) ..... JP2018-051061

(51) Int. Cl.

| | |
|---|---|
| ***B41M 1/12*** | (2006.01) |
| ***B41F 15/08*** | (2006.01) |
| ***B41F 15/34*** | (2006.01) |
| ***B41N 1/24*** | (2006.01) |

(52) U.S. Cl.

CPC ..... *B41F 15/34* (2013.01); *B41F 15/08* (2013.01); *B41F 15/0895* (2013.01); *B41M 1/12* (2013.01); *B41N 1/24* (2013.01)

(58) Field of Classification Search

CPC ..... B41F 15/0868; B41F 15/0872; B41F 15/0877; B41F 15/0881; B41F 15/0886; B41F 15/089; B41F 15/0895; B41N 1/24; B41N 1/248; H05K 3/1216; H05K 3/1225; H05K 3/1233; B41M 1/12

USPC ..... 101/127, 115

See application file for complete search history.

(56) References Cited

U.S. PATENT DOCUMENTS

| | | | | |
|---|---|---|---|---|
| 4,925,705 A | | 5/1990 | Hill | |
| 5,046,415 A | * | 9/1991 | Oates | G03F 7/12 101/128.21 |
| 2012/0000380 A1 | * | 1/2012 | Tanaka | B41F 35/005 101/114 |

FOREIGN PATENT DOCUMENTS

| | | | |
|---|---|---|---|
| JP | 62-222883 | | 9/1987 |
| JP | 2004207350 A | * | 7/2004 |
| JP | 2013-166248 | | 8/2013 |

OTHER PUBLICATIONS

English translation of JP 2004-207350A, publication date Jul. 22, 2004. (Year: 2004).*

* cited by examiner

*Primary Examiner* — Leslie J Evanisko

(74) *Attorney, Agent, or Firm* — Amin, Turocy & Watson, LLP

(57) ABSTRACT

A printing apparatus includes a screen with an opening through which ink passes. A resin material is formed with a recessed portion and a projection relatively projecting from the recessed portion. When a top surface of a projection is printed with ink, an inner edge of the opening is displaced toward the recessed portion. The height of an ink droop formed at the inner edge of the opening is set to be smaller than a depth of the recessed portion at a position facing the ink droop.

5 Claims, 11 Drawing Sheets

SCREEN PRINTING APPARATUS AND METHOD OF PRINTING INCLUDING CONTROLLING THE HEIGHT OF THE INK DROOP

CROSS-REFERENCE TO RELATED APPLICATION

This application is based upon and claims the benefit of priority from Japanese Patent Application No. 2018-051061 filed on Mar. 19, 2018, the contents of which are incorporated herein by reference.

BACKGROUND OF THE INVENTION

Field of the Invention

The present invention relates to a printing apparatus and a printing method for printing ink on a projection relatively projecting from a recessed portion continuously formed with the projection.

Description of the Related Art

Resin molded articles having inside decorative layers partially visible from outside have been widely used as, for example, a casing of a so-called smart key or the like. The decorative layer is visually recognized by the user as a decorative pattern such as letters (characters), symbols, figures or the like.

Japanese Laid-Open Patent Publication No. 2013-166248 proposes a technology for enabling a decorative layer of this kind to be visually recognized three-dimensionally. That is, in the technology described in Japanese Laid-Open Patent Publication No. 2013-166248, a vapor deposited film is formed on a slant surface of a first resin molded article, and a printed layer is further formed on the surface of the vapor deposited film to form the decorative layer. Then, a liquid curable resin and a second sheet are covered on the decorative layer, and the liquid curable resin is cured thereafter to obtain a resin molded article ("decorative panel" in Japanese Laid-Open Patent Publication No. 2013-166248).

In a resin material with a recess formed therein, a projection formed continuously with the recess projects relatively to the recess. When a metal layer formed in the recess functions as an ornamental portion, the resin material is provided with a shielding layer which makes the metal layer formed outside the recess invisible. Generally, the shielding layer is formed of a black-colored printed layer provided, for example, by screen printing.

As described in Japanese Laid-Open Patent Publication No. 62-222883, a screen formed with an outlet for ink feeding is used in screen printing. The outlet is positioned correspondingly to the top surface of the projection and the ink is fed in this state, so that the top surface of the projection is printed with ink fed through the outlet.

SUMMARY OF THE INVENTION

In contrast to the projection printed with ink as explained above, because the recess is covered with a closed portion of the screen, the walls defining the recess is not printed with ink basically. However, according to an intensive research by the inventors, the walls defining the recess are also printed with ink in some cases. In such cases, the metal layer formed in the recess becomes invisible so that the ornamental portion loses its three-dimensional appearance, and further a desirable shape cannot be easily obtained with high accuracy.

A primary object of the present invention is to provide a printing method capable of addressing concerns over printing ink on walls defining a recess.

Another object of the present invention is to provide a printing apparatus capable of implementing the above-mentioned printing method.

According to one embodiment of the present invention, there is provided a printing apparatus for printing ink on a top surface of a projection of a resin material, the projection relatively projecting continuously from a recessed portion recessed from one end side toward another end side of the resin material, the printing apparatus comprising:

a pedestal portion supporting the resin material;

a screen formed with an opening through which the ink passes, wherein an edge of the opening of the screen is displaced toward the recessed portion in a state where the ink is applied to the top surface of the projection, and a height of an ink droop formed at the edge of the opening is smaller than a depth of the recessed portion at a position facing the ink droop.

According to another embodiment of the present invention, there is provided a printing method for printing ink on a top surface of a projection of a resin material, the projection relatively projecting continuously from a recessed portion recessed from one end side toward another end side of the resin material, the printing method comprising the steps of:

supporting the resin material on a pedestal portion of a printing apparatus; and positioning an opening formed in a screen of the printing apparatus to face the top surface of the projection, and printing the ink on the top surface of the projection by passing the ink through the opening, wherein in the step of printing the ink, an edge of the opening is displaced toward the recessed portion, and a height of an ink droop formed at the edge of the opening is set to be smaller than a depth of the recessed portion at a position facing the ink droop.

In the present invention, as mentioned above, the edge of the opening through which the ink passes is displaced toward the recessed portion. Although an ink droop is formed at the edge of the opening, the ink droop is separated from a side surface of the recessed portion as one wall surface due to the displacement. As a result, the ink is prevented from being applied to the side surface of the recessed portion and also from running down to reach the bottom surface of the recessed portion.

That is, in the present invention, the top of the projection can be selectively printed with ink, so as to avoid formation of printed layer in the recessed portion. Accordingly, a metal layer formed subsequently to the printed layer can be visually recognized with a desired shape and dimensions. As a result, it is possible to make the metal layer recognizable as an ornamental portion with a desired shape and dimensions. In other words, it is possible to obtain an ornamental portion excellent in accuracy.

The height of the ink droop can be controlled by adjusting at least one of a viscosity of the ink and the number of printing appropriately. If the viscosity of ink is small (high fluidity), the ink droop grows relatively large, that is, becomes greater in height, even with a smaller number of printing. On the other hand, if the viscosity of ink is large (low fluidity), the ink droop grows relatively slowly even by repeated printing.

The former is advantageous in easy printing because the opening is less likely to be suffered from clogging; the latter is advantageous in the increased number of printing until the height of the ink droop reaches the tolerance.

If the height of the ink droop exceeds the tolerance, the ink droop can be removed by wiping out. However, if the ink droop is wiped out every time after one printing operation, the printing is interrupted and the number of printing per unit time becomes small. To be more efficient, it is desirable to wipe the ink droop out after several printing operations, to be more precise, after carrying out the printing operation on a multiple number of resin materials. As described above, the number of printing until the ink droop needs to be wiped out can be controlled by adjusting the viscosity of the ink.

According to the present invention, the edge of the opening of the screen, through which the ink passes, is displaced toward the recessed portion continuous with the projection, the top surface of which is to be printed with ink. The opening is so displaced that the ink can be prevented from being applied to the side surface of the recess and further running down the side surface toward the bottom surface of the recessed portion.

As a result, only the top surface of the projection can be printed with ink selectively. Because the printed layer is prevented from being formed in the recessed portion, the metal layer formed in the recessed portion after formation of the printed layer can be visually recognized with desired shape and dimensions. Thus, the metal layer is obtained with a desired shape and dimensions. Such a metal layer is recognizable, for example, as an ornamental portion. An ornamental portion with high accuracy can bet thus obtained.

The above and other objects, features, and advantages of the present invention will become more apparent from the following description when taken in conjunction with the accompanying drawings, in which a preferred embodiment of the present invention is shown by way of an illustrative example.

DESCRIPTION OF THE PREFERRED EMBODIMENTS

Hereinafter, with reference to the accompanying drawings, a printing apparatus, a printing method according to the present invention and a resin molded article obtained thereby will be described in detail based on an embodiment which is preferable in connection with a printing apparatus and a printing method.

Figure 1:
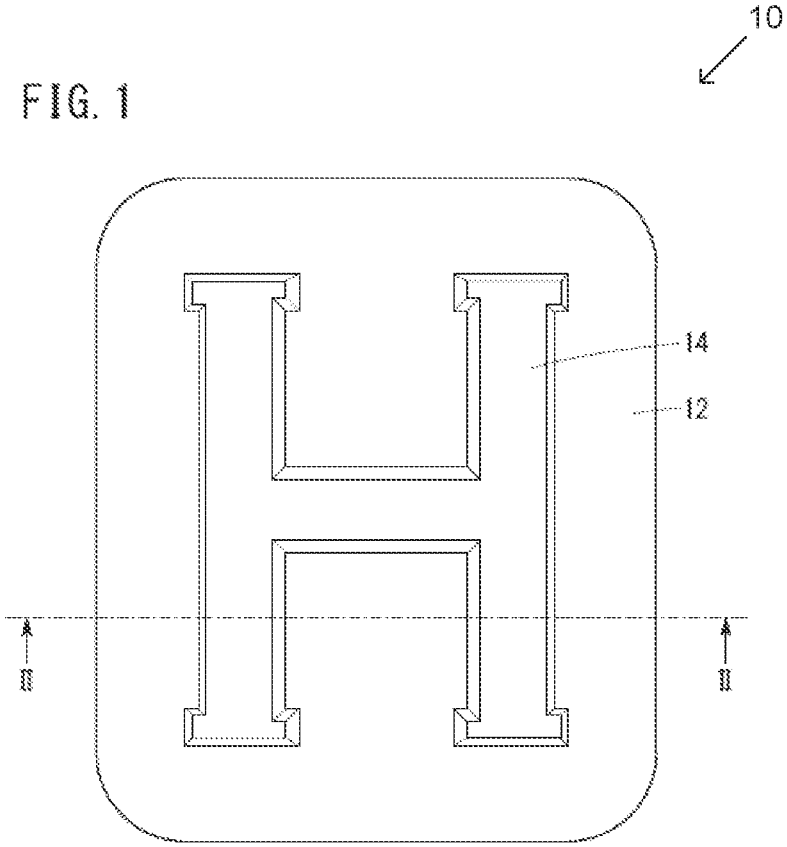
FIG. 1 is a plan view of a resin molded article obtained by an embodiment of the present invention.
Figure 2:
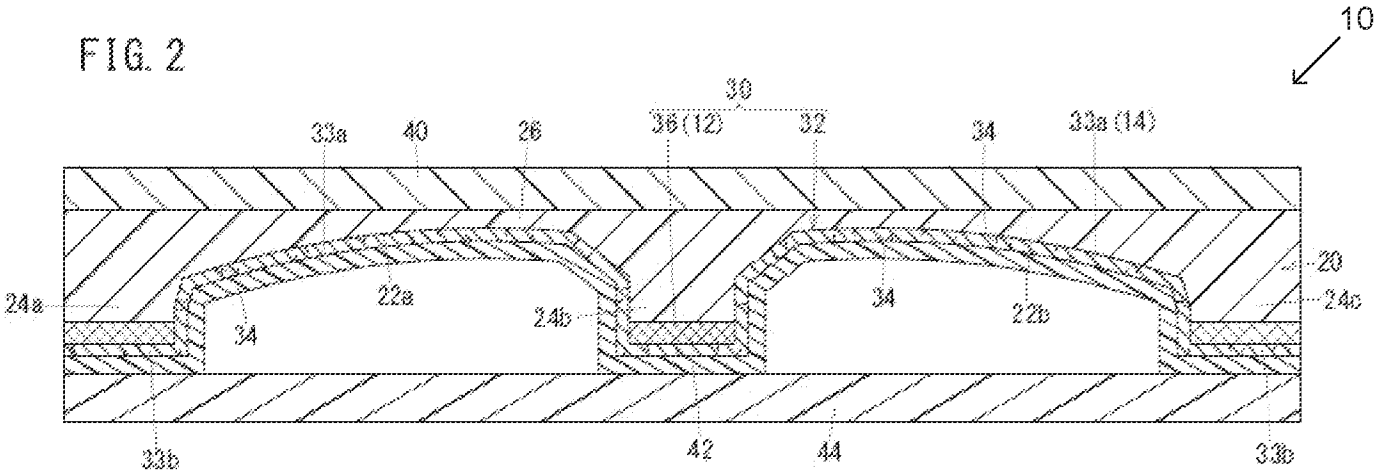
FIG. 2 is a sectional view of the resin molded article taken along the line II-II in FIG. 1.

FIG. 1 is a plan view of a resin molded article 10 according to the present embodiment, and FIG. 2 is a sectional view of the resin molded article taken along the line II-II in FIG. 1. This resin molded article 10 comprises a laminated film provided with an ornamental portion 14 on a plain portion 12. In this case, the ornamental portion 14 is formed by an ornamental character "H", and the ornamental character is visually recognizable as if to emerge three-dimensionally from the plain portion 12.

The resin molded article 10 has a resin base layer 20. Hereafter, a lower side and an upper side in FIG. 2 of the resin base layer 20 will be described respectively as a lower end and an upper end. In the lower end, two recessed portions 22*a*, 22*b* are formed in a groove shape extending from the front side toward the rear side of the drawing sheet of FIG. 2. These recessed portions 22*a*, 22*b* respectively correspond to two vertical leg portions of the ornamental character "H". Further, protruding portions 24*a* to 24*c* protrude relative to the recessed portions 22*a*, 22*b* on the lateral sides of the recessed portions 22*a*, 22*b*.

The recessed portions 22*a*, 22*b* are dented toward the upper end (toward a cover layer 40 referred to later). Further, the recessed portions 22*a*, 22*b* become deeper toward each other. That is, the recessed portions 22*a*, 22*b* are deepest at positions facing each other and are shallowest at positions being farthest from each other. Incidentally, a recessed portion (not shown) forming a horizontal bar portion of the ornamental character "H" is substantially as degree as the deepest portions of the recessed portions 22*a*, 22*b*.

A metal layer 32 of a decorative layer 30 is provided all over the lower end surface including the recessed portions 22*a*, 22*b* of the resin base layer 20. Of this metal layer 32, portions (hereafter referred to as "correspondingly recessed portions 33*a*") provided at the recessed portions 22*a*, 22*b* are visually recognized as ornamental portions 14. The metal layer 32 further improves its design quality with gloss.

The metal layer 32 are desirable to include ultrafine voids, that is, discontinuities 34 which are formed by aggregated bubbles of opening pores, closed pores and the like. This is because, as will be described later, the discontinuities (ultrafine voids) 34 make the resin molded article 10 easily curved and also make cracks or the like hard to be produced in the metal layer 32. The discontinuities 34 may be openings (opening pores) open to the surface of the metal layer 32 or may be closed interior spaces (closed pores).

Portions of the metal layer 32 except for the correspondingly recessed portions 33*a* (hereafter referred to as correspondingly flat portions 33*b*) are covered with a printed layer 36 as a shielding layer. In other words, the printed layer 36 is interposed between the correspondingly flat portions 33*b* of the metal layer 32 and the resin base layer 20. Thus, from the user using the resin molded article 10, the correspondingly flat portions 33*b* are hidden behind the printed layer 36 and thus, are invisible. This printed layer 36 and the metal layer 32 form the decorative layer 30.

It is preferable that the printed layer 36 be black in color. This is because, in this case, the difference in the contrast to the gloss of the metal layer 32 becomes large and improves the appearance of the ornamental portion 14.

The resin base layer 20 is formed of an ultraviolet curable resin. The ultraviolet curable resin is relatively flexible, and thus, the resin molded article 10 is easily curved when given an external force to bend the resin molded article 10. In this manner, the resin base layer 20 formed of the ultraviolet curable resin is a layer that gives flexibility to the resin molded article 10.

Here, the printed layer 36 is flexible in comparison to the resin base layer 20. More specifically, the printed layer 36 is larger in elongation percentage than the resin base layer 20 and is smaller in Shore D hardness than the resin base layer 20. This enables the decorative layer 30 to be flexed (curved) easily to follow the resin base layer 20. Accordingly, it is avoided that the decorative layer 30 peels off from the resin base layer 20 due to the difference in flexibility.

Incidentally, the elongation percentage is measured in accordance with a so-called B method which is specified by JIS K 7161 (conforming to ASTM D 638). The respective elongation percentages of the resin base layer 20 and the printed layer 36 are, for example, about 1 to 100% and 1 to 200%, respectively. Further, the respective Shore D hardness of the resin base layer 20 and the printed layer 36 are, for example, about 60° to 90° and 70° to 90°, respectively.

Further, examples of the material suitable as the metal layer 32 include indium, tin, alloys thereof or the like. In this case, it is easy to obtain the metal layer 32 having the discontinuities 34. Further, since these metals are radio wave transmissive, the interference in the communication from a smart key to a vehicle body can be avoided in the case where the resin molded article 10 is used as a casing of the smart key. On the other hand, examples of the material suitable as the printed layer 36 include urethane resins, vinyl chloride resins or the like.

The upper end of the resin base layer 20 is formed as a flat portion 26. The flat portion 26 is provided on the upper surface with a cover layer 40 formed of a polymer membrane 40*a* (refer to FIG. 5). Polyethylene terephthalate (PET) is quoted as a preferable example of a polymer forming the cover layer 40.

The resin base layer 20 and the cover layer 40 are each thin and transparent enough to transmit lights. Thus, when the user looks down on the resin molded article 10 from the outside of the cover layer 40, it is possible to visually recognize the ornamental portion 14 (the correspondingly recessed portions 33*a* of the metal layer 32) easily.

In the aforementioned configuration, the metal layer 32 is provided on its lower surface with a support layer 42 for preventing the decorative layer 30 from falling off the resin base layer 20. The support layer 42 is formed of, for example, urethane resins, vinyl chloride resins or the like and is formed in a shape to follow the shape of the metal layer 32.

Further, there is provided an adhesive tape 44 for enabling the resin molded article 10 to be affixed to an article. The adhesive tape 44 is spanned between flat portions of the support layer 42.

Next, advantageous effects of this resin molded article 10 will be described.

Figure 3:
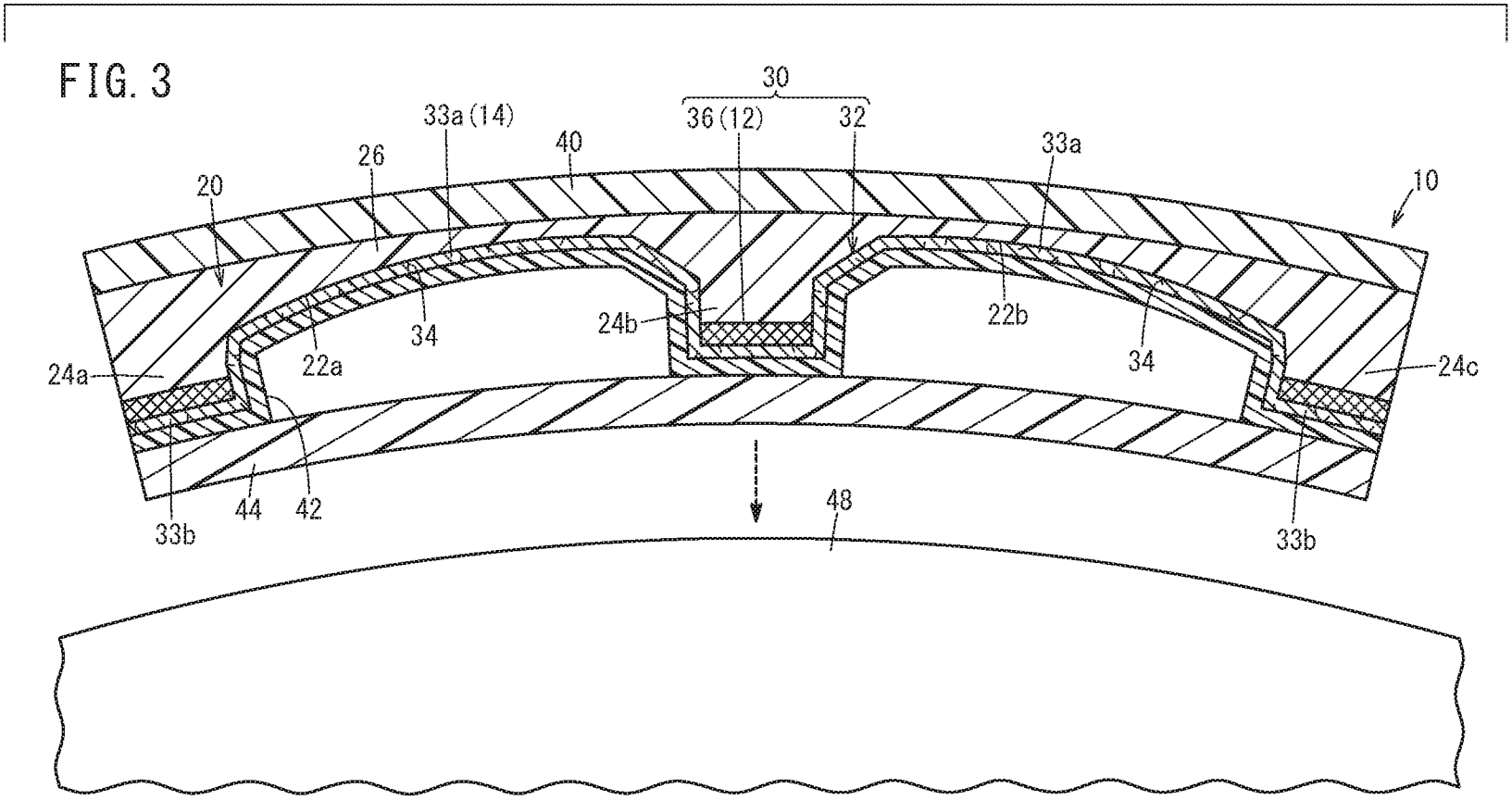
FIG. 3 is a schematic longitudinal sectional view showing a state that the resin molded article shown in FIG. 1 is curved and affixed to an article.

As shown in FIG. 3, the resin molded article 10 is affixed to an article 48 such as a casing of a smart key or the like, by means of the adhesive tape 44. In the case where the article 48 has a curved surface, the resin molded article 10 is curved to follow the curved surface of the article 48. As mentioned before, the resin base layer 20 is formed of the ultraviolet curable resin which is relatively flexible. Further, the printed layer 36 of the decorative layer 30 is flexible in comparison with the resin base layer 20. Therefore, the printed layer 36 is easily flexed (curved) to follow the resin base layer 20. In addition, the metal layer 32 is small in rigidity in the case of including the discontinuities 34 and is thus easy to be curved. For the reasons mentioned above, the decorative layer 30 becomes hard to be peeled off from the resin base layer 20, and the resin molded article 10 is curved easily.

In addition, when the metal layer 32 is curved, the discontinuities 34 allow the atoms to easily separate form one another. Thus, cracks or the like become hard to be produced in the metal layer 32. Accordingly, it is possible to keep the quality in appearance of the ornamental portion 14.

Accordingly, it is possible to easily affix the resin molded article 10 to a roundish article 48 and make the ornamental portion 14 aesthetic after affixing.

In addition, what the user can visually recognize is only the correspondingly recessed portions 33*a* of the metal layer 32. Because the recessed portions 22*a*, 22*b* are three-dimensionally shaped, the user recognizes the ornamental portion 14 as three-dimensional. In this manner, according to the present embodiment, it is easy to provide a three-dimensional appearance to the ornamental portion 14 sufficiently.

Next, the manufacturing method of the resin molded article 10 will be described.

Figure 4:
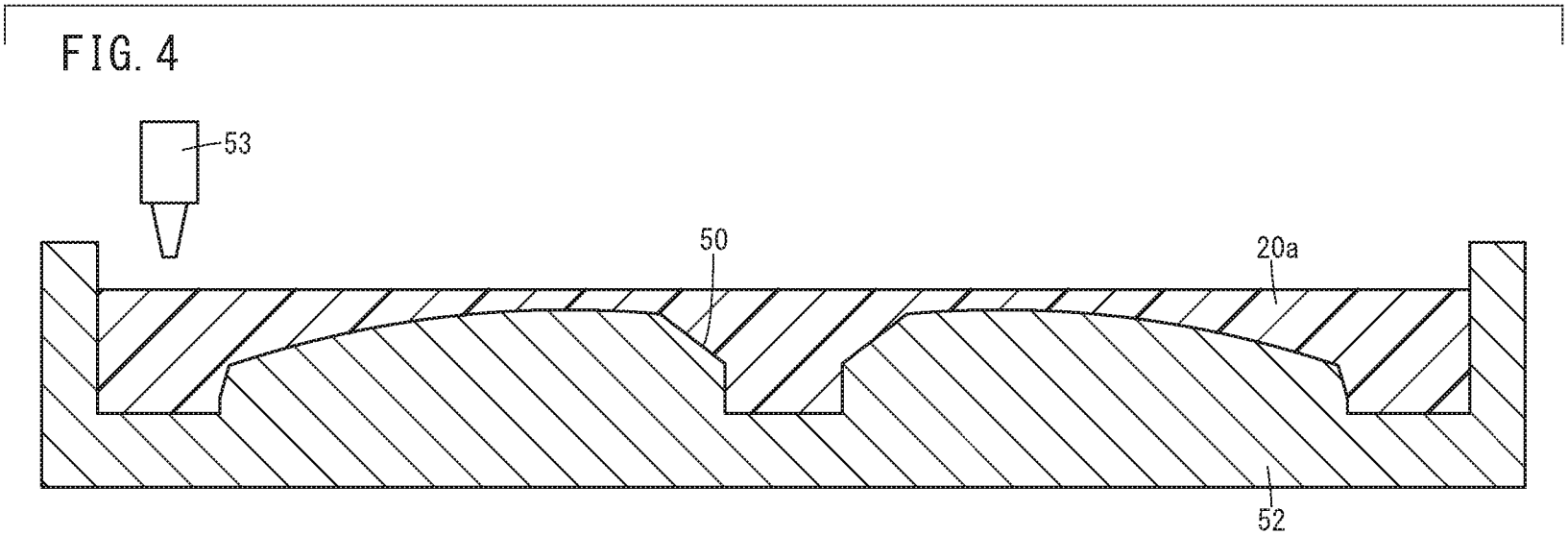
FIG. 4 is a schematic longitudinal sectional view showing a state that a cavity of a metal mold is filled with an ultraviolet curable resin.

First of all, as shown in FIG. 4, an ultraviolet curable resin 20*a* is injected into a metal mold 52 which is formed with a cavity 50 of the shape forming the ornamental character "H". The injection is performed by using a dispenser 53, and those portions overflowing from the cavity 50 merge to be connected.

Figure 5:
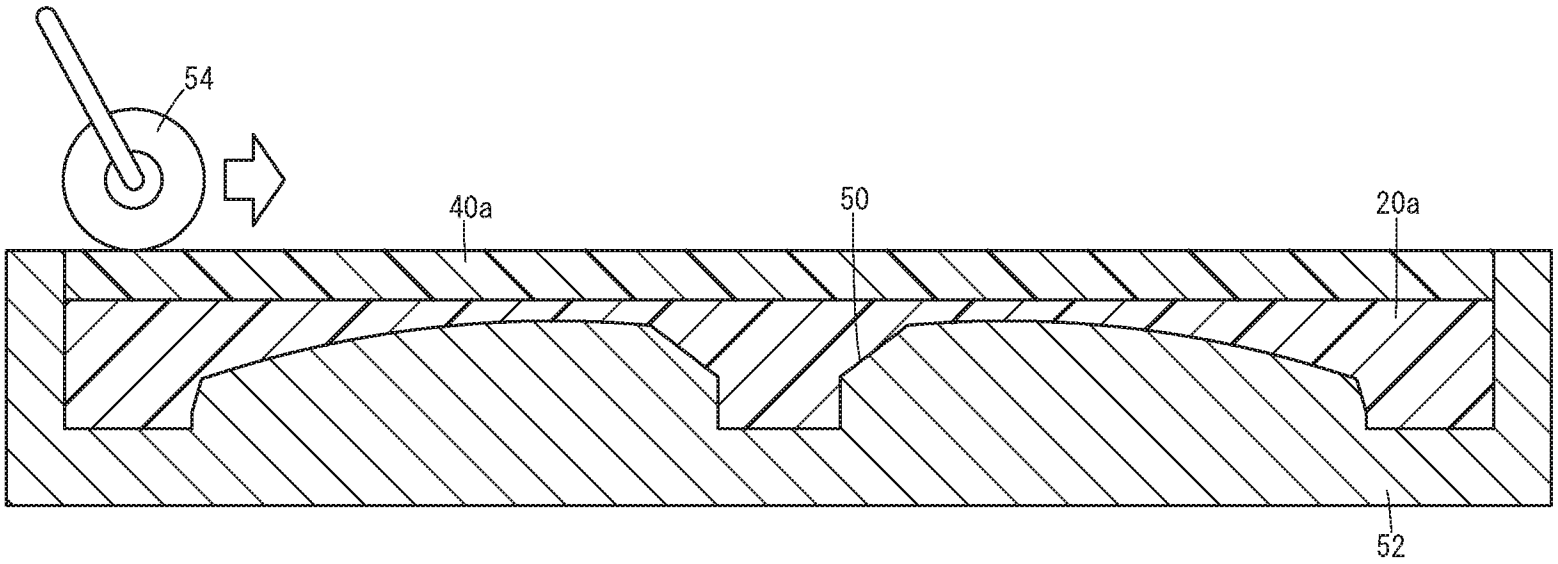
FIG. 5 is a schematic longitudinal sectional view showing a state that a polymer membrane is mounted on the ultraviolet curable resin and that pressuring is performed by a roller being an equalizer member.

Next, as shown in FIG. 5, the polymer membrane 40*a* is mounted on the ultraviolet curable resin 20*a*, and pressed by a roller 54 (flattener). In this state, the roller 54 is advanced toward the arrowed direction, whereby the ultraviolet curable resin 20*a* is leveled out to be adjusted in thickness. Although moving the roller 54 once in one way is sufficient, the roller 54 may be moved once in two ways, if necessary.

Figure 6:
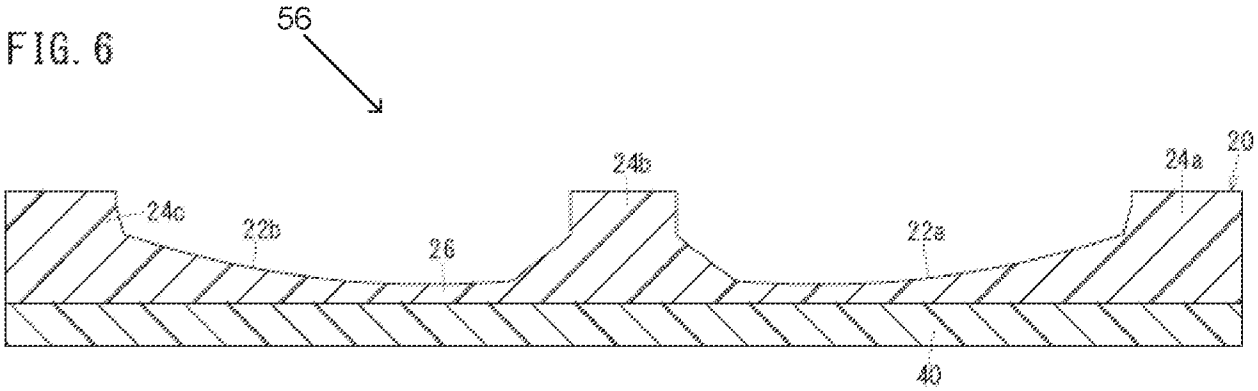
FIG. 6 is a schematic longitudinal sectional view of a composite body having a resin base layer and a cover layer.

After the thickness of the ultraviolet curable resin 20*a* is adjusted like this, ultraviolet rays are irradiated on the ultraviolet curable resin 20*a*. Thus, the ultraviolet curable resin 20*a* is cured (i.e., hardened) to be formed as the resin base layer 20. Further, the polymer membrane 40*a* functions as the cover layer 40. A composite body 56 composed of the resin base layer 20 and the cover layer 40 is thus obtained, as shown in FIG. 6. The resin base layer 20 has the protruding portions 24*a* to 24*c* which are formed by curing the resin filling the cavity 50, the recessed portions 22*a*, 22*b* between the protruding portions 24*a* to 24*c*, and the flat portion 26 which is formed by curing the resin overflown from the cavity 50 and pressured by the roller 54.

Figure 7:
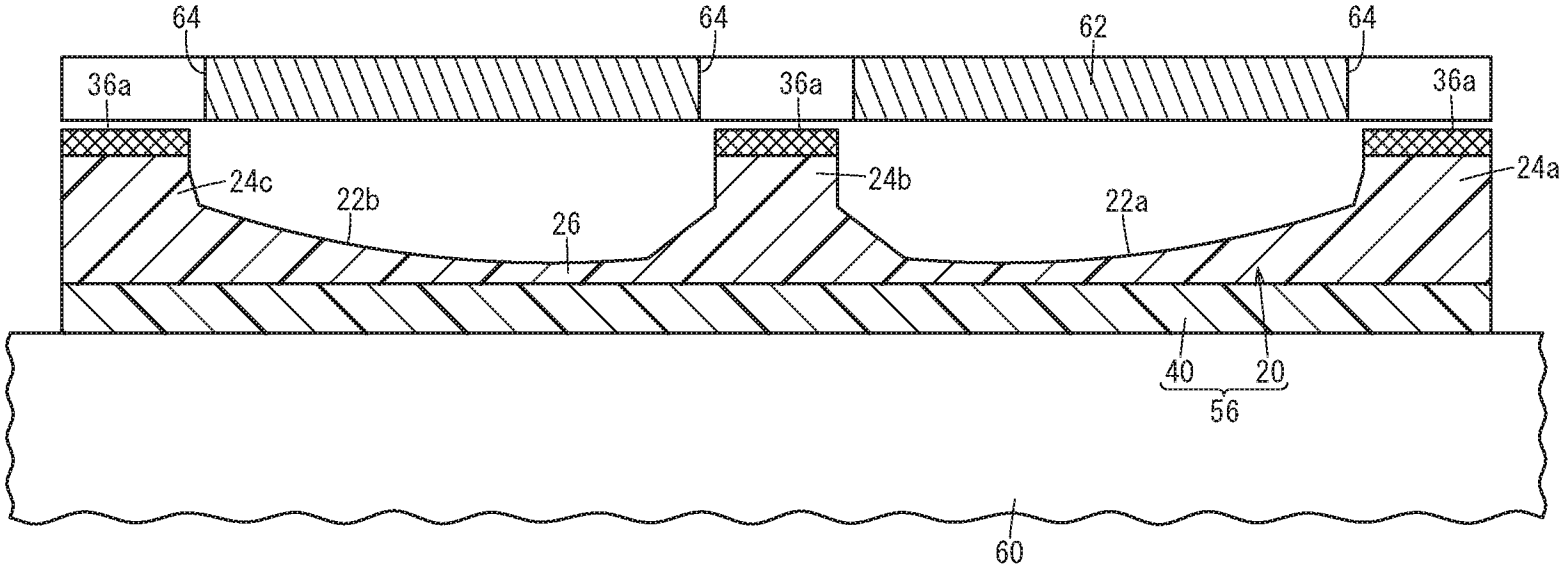
FIG. 7 is a schematic longitudinal sectional view showing a state that ink is printed on the composite body shown in FIG. 6 by a screen printing apparatus according to the embodiment of the present invention.

Then, the composite body 56 is set on a screen printing apparatus (printing apparatus). The screen printing apparatus is equipped with a pedestal portion 60 and a screen 62 shown in FIG. 7. The composite body 56 is held on the pedestal portion 60 with its flat portion 26 directed downward. Furthermore, ink 36*a* becoming the printed layer 36 is printed on the top surfaces of the protruding portions 24*a* to 24*c*.

Here, the screen 62 is formed with passage openings 64 through which the ink 36*a* passes. In the prior art, in the case where the ink 36*a* is printed on the top surfaces of the protruding portions 24*a* to 24*c*, the passage openings 64 are formed to dimensions agreeing with the areas of the top surfaces of the protruding portions 24*a* to 24*c* and are superposed on the top surfaces of the protruding portions 24*a* to 24*c*. In this case, the ink 36*a* may disadvantageously flow along the side surfaces of the recessed portions 22*a*, 22*b* and reach the bottom surfaces of the recessed portions 22*a*, 22*b*. The occurrence of the situation like this results in forming the printed layer 36 at each of the bottom surfaces.

On the contrary, in the present embodiment, the passage openings 64 are formed to be slightly wider than the top surfaces of the protruding portions 24*a* to 24*c*, so that inner edge portions of the passage openings 64 overlap the recessed portions 22*a*, 22*b*. That is, the inner edge portions of the passage openings 64 are set to be partly over the recessed portions 22*a*, 22*b*. The ink 36*a* is supplied in this state.

Figure 8:
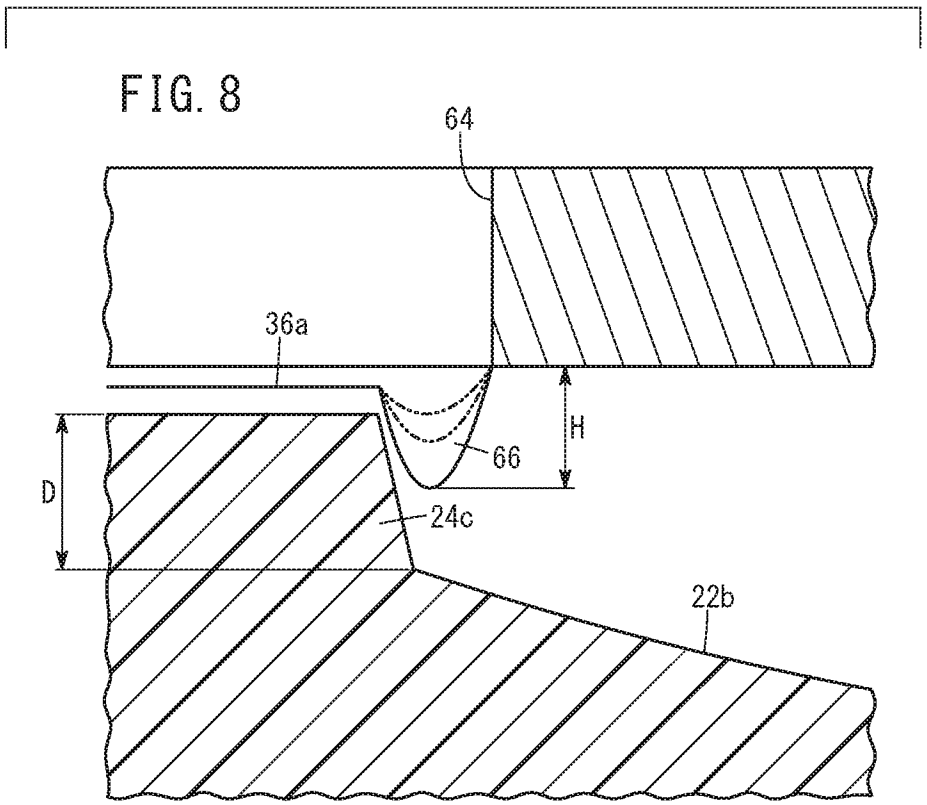
FIG. 8 is an enlarged sectional view of an important portion shown in FIG. 7.

At this time, the ink 36*a* at the inner edge portions of the passage openings 64 slightly droops toward the recessed portions 22*a*, 22*b* and remains in this state. As a result, there are formed ink droops 66 as typically shown in FIG. 8. The maximum droop height H of each of the ink droops 66 is set to be shorter than the depth D of the recessed portions 22*a*, 22*b* at positions facing the ink droops 66. Thus, the ink droops 66 can be prevented from adhering to the side surfaces and the bottom surfaces of the recessed portions 22*a*, 22*b*. Incidentally, as understood from FIG. 8, the depth D of the recessed portions 22*a*, 22*b* at positions facing the ink droops 66 is also the minimum depth of the recessed portions 22*a*, 22*b*. In other words, the maximum droop height H may be set to be smaller than the minimum depth of the recessed portions 22*a*, 22*b*.

It is possible to adjust the maximum droop height H of the ink droops 66 by properly adjusting the viscosity of the ink 36*a* or the number of printing operation times. That is, in the case where the viscosity of the ink 36*a* is large, one printing operation does not cause the ink droop 66 to grow so much. Therefore, it is possible to repeat the printing operations to a certain number of times, in other words, to increase the number of printing operation times to the certain number of times. Then, when the maximum droop height H of the ink droop 66 exceeds a tolerable range, the ink droop 66 should be wiped out.

Figure 9:
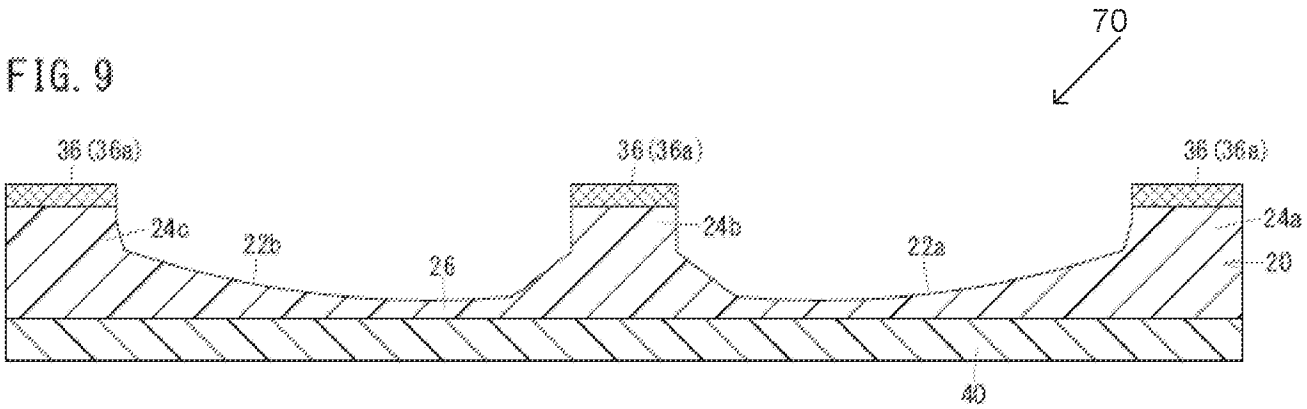
FIG. 9 is a schematic longitudinal sectional view of the composite body having the resin base layer and the cover layer and formed with a printed layer on the top surfaces of protruding portions constituting the resin base layer.

In this way, as shown in FIG. 9, the composite body 70 can be obtained in which the ink 36*a* is printed only on the top surfaces of the protruding portions 24*a* to 24*c*, in other words, the printed layer 36 is formed.

Figure 10:
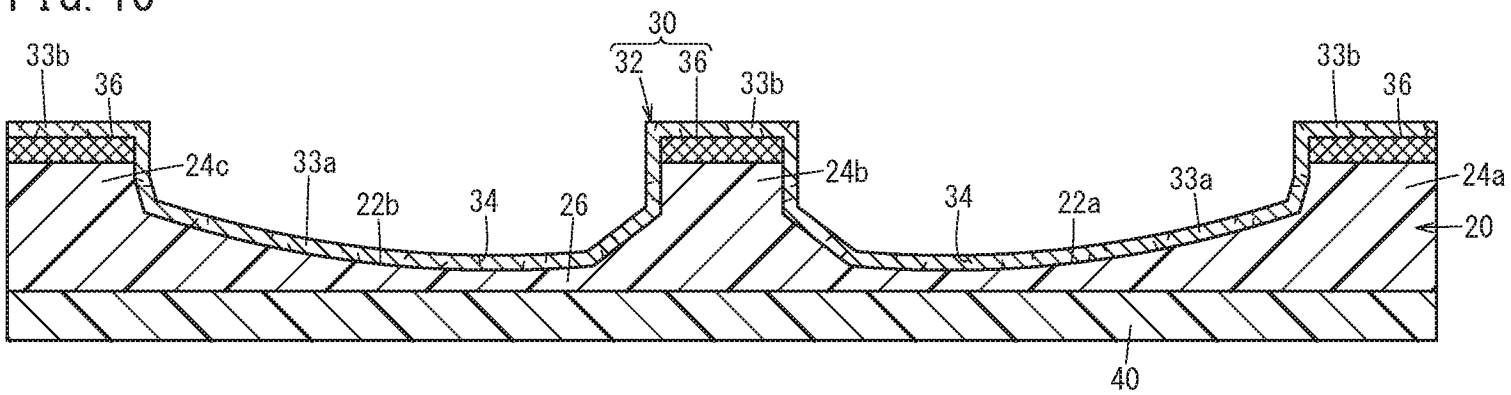
FIG. 10 is a schematic longitudinal sectional view showing a state that a metal layer is provided on the composite body shown in FIG. 9.

Subsequently, the metal layer 32 is formed as shown in FIG. 10. At this time, metal deposition can be done. Incidentally, it is preferable to choose indium, tin, alloys thereof or the like as the metal. This is because these are discontinuous metals and hence because it is possible in this case to easily obtain the metal layer 32 having the discontinuities 34 and showing radio wave transmissivity.

Figure 11:
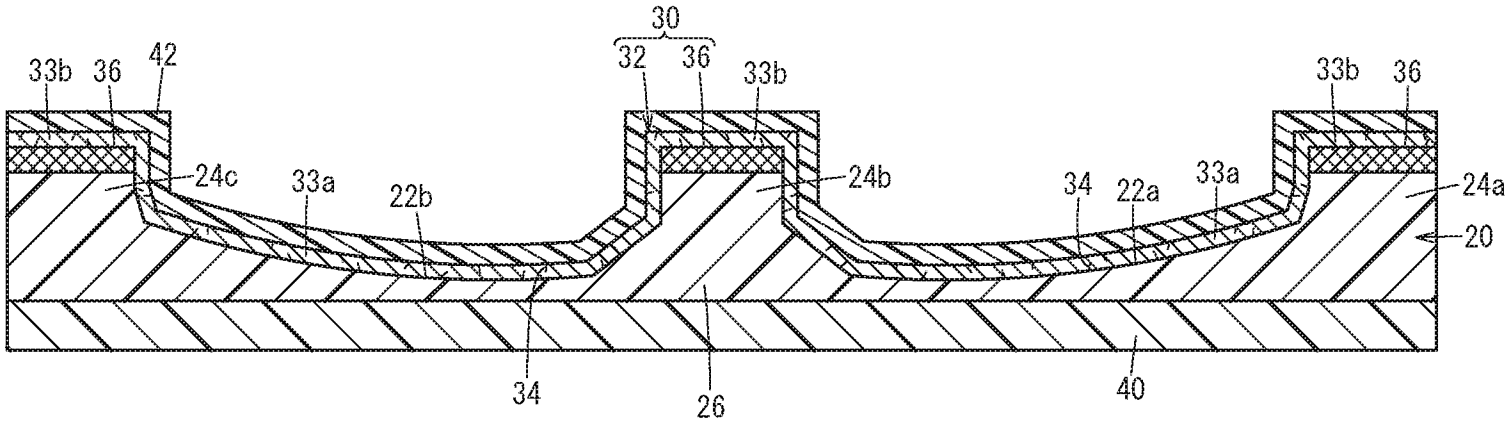
FIG. 11 is a schematic longitudinal sectional view showing a state that a support layer is further provided on the composite body shown in FIG. 10.

As need arises, the support layer 42 is formed on the metal layer 32 as shown in FIG. 11. It is possible to form the support layer 42 by, for example, spraying urethane resins, vinyl chloride resins or the like by a coating machine. Thus, the support layer 42 following the shape of the metal layer 32 is obtained, whereby the resin molded article 10 is obtained. Any portion not to be formed with the support layer 42 may be covered by masking.

Thereafter, the adhesive tape 44 is affixed to the plain portions of the support layer 42 (refer to FIG. 2). As a consequence, it becomes possible to affix the resin molded article 10 to the article 48 such as the casing of the smart key or the like through the adhesive tape 44.

As described above, according to the present embodiment, the printed layer 36 is formed only on the top surfaces of the protruding portions 24*a* to 24*c* but is refrained from being formed on the side surfaces and the bottom surfaces of the recessed portions 22*a*, 22*b*. Thus, the user is able to visually recognize only the metal layers 32 (correspondingly recessed portions 33*a*) provided at the recessed portions 22*a*, 22*b*. Therefore, it is possible to recognize the metal layer 32 as the ornamental portion 14 with gloss so as to be excellent in stereoscopic effect.

In addition, because the correspondingly recessed portions 33*a* can be visually recognized without any partial omission and because the correspondingly flat portions 33*b* are invisible, the ornamental portion 14 can be recognized as the ornamental character "H" having a desired shape and dimension. That is, it is possible to accurately obtain the ornamental portion 14 as one having the desired shape and dimension.

The same process as described above is repeated for a next resin molded article 10. The repetition of this process causes the ink droop 66 (refer to FIG. 8) to grow. When the maximum droop height H of the ink droop 66 exceeds the tolerable range, the wiping-out (removing) of the ink droop 66 is performed. It is possible to increase the number of printing operation times per unit time with an increase in the number of repetition times until the wiping-out becomes due.

The present invention is not particularly limited to the foregoing embodiment and may be variously altered without departing from the gist of the present invention.

For example, the support layer 42 may be formed as need arises, and can be dispensed with in dependence on the joining strength between the metal layer 32 and the resin base layer 20.

What is claimed is:

1. A combination of a resin material, an ink, and a printing apparatus, the printing apparatus for printing the ink on a top surface of a projection of the resin material, the projection relatively projecting continuously from a recessed portion recessed from one end side toward another end side of the resin material, the combination of the resin material, the ink, and the printing apparatus comprising:

a pedestal portion supporting the resin material;

a screen formed with an opening through which the ink passes, wherein a size of the opening of the screen is greater than a size of the top surface of the projection, the opening of the screen and the projection are arranged in a manner that an ink droop of the ink is formed at an edge of the opening in a state where the ink is applied to the top surface of the projection, and the printing apparatus is configured to form the ink droop to have a height smaller than a depth of the recessed portion at a position facing the ink droop.

2. The printing apparatus according to claim 1, wherein the printing apparatus prints the ink only on the top surface of the projection.

3. A printing method for printing ink on a top surface of a projection of a resin material, the projection relatively projecting continuously from a recessed portion recessed from one end side toward another end side of the resin material, the printing method comprising the steps of:

supporting the resin material on a pedestal portion of a printing apparatus;

positioning an opening formed in a screen of the printing apparatus to face the top surface of the projection, and printing the ink on the top surface of the projection by passing the ink through the opening, wherein a size of the opening formed in the screen is greater than a size of the top surface of the projection during the printing the ink, and an edge of the opening is offset from the top surface of the projection toward the recessed portion; and forming an ink droop at the edge of the opening is set to have a height smaller than a depth of the recessed portion at a position facing the ink droop, wherein the forming the ink droop inhibits the ink from being applied to a side surface of the recessed portion.

4. The printing method according to claim 3, wherein the height of the ink droop is controlled by adjusting at least one of a viscosity of the ink and a number of printing operations.

5. The printing method according to claim 3, wherein the ink droop is wiped out after carrying out printing the ink on a plurality of resin materials.

* * * * *